US005901873A

United States Patent [19]

Moore

[11] Patent Number: 5,901,873

[45] Date of Patent: May 11, 1999

[54] SELF-SEATING SELF-SEALING LABWARE ADAPTER

[75] Inventor: Patrick Q. Moore, Gilroy, Calif.

[73] Assignee: Beckman Instruments, Inc., Fullerton, Calif.

[21] Appl. No.: 08/846,142

[22] Filed: Apr. 25, 1997

[51] Int. Cl.[6] ..... B65D 39/00

[52] U.S. Cl. ..... 220/669; 494/16; 215/296

[58] Field of Search ..... 220/656, 657, 220/658, 659, 669, 672; 215/296, 364; 494/16; 422/72, 102

[56] References Cited

U.S. PATENT DOCUMENTS

| | | | |
|---|---|---|---|
| 2,921,708 | 1/1960 | Marcel | 215/296 X |
| 3,071,316 | 1/1963 | Piemonte et al. | 494/16 |
| 3,265,296 | 8/1966 | Mitchell | 494/16 |
| 4,076,170 | 2/1978 | Chulay et al. | 233/26 |
| 4,080,175 | 3/1978 | Chulay et al. | 23/292 |
| 4,290,550 | 9/1981 | Chulay et al. | 233/26 |
| 4,304,356 | 12/1981 | Chulay et al. | 233/26 |
| 5,127,895 | 7/1992 | Pawlovich | 494/16 |
| 5,288,466 | 2/1994 | Burns | 494/16 X |
| 5,361,922 | 11/1994 | Moore et al. | 215/364 |
| 5,384,096 | 1/1995 | Burns | 494/16 X |
| 5,395,001 | 3/1995 | Moore | 215/364 |
| 5,720,925 | 2/1998 | Oehme | 422/102 |

*Primary Examiner*—Steven Pollard
*Attorney, Agent, or Firm*—William H. May; P. R. Harder; Thomas Schneck

[57] ABSTRACT

A labware adapter having a tubular body with upper and lower spaced apart annular collars, serving to guide the adapter into a rotor bore, while at the same time defining a fluid reservoir between the two collars and the inside wall of the rotor. The upper collar has peripheral indentations through which fluid can pass for ingress into the reservoir in the event of sample leakage from the internal portion of the adapter. The lower collar has a vent channel for allowing fluid to move past the collar, for example on insertion of the adapter into a rotor bore. The indentations, vent channel and reservoir all provide mass relief for the adapter, lowering the overall moment of inertia for the adapter, compared to one fitting into the same bore with a smooth tubular shape. The tubular body has an annular ridge above the upper annular collar defining seal glands so that a cylindrical cap can be fit over the ridge in sealed relation with the tubular body. The cap is threadless and is pressed over elastomer seals in the seal glands. Centrifugal loading of the cap onto the tubular body enhances sealing action.

21 Claims, 4 Drawing Sheets

SELF-SEATING SELF-SEALING LABWARE ADAPTER

TECHNICAL FIELD

The invention relates to sealable adapters which reduce the bore size in rotors of centrifuges.

BACKGROUND ART

Adapters are frequently used in centrifuges to reduce bore size in rotors, particularly when specimens are confined in sealed labware. Specimens which are toxic, corrosive, sensitive to the ambient environment or accurately measured are often contained in sealed cuvettes, flasks or the like to preserve specimen integrity. When there is a need to centrifuge such specimens, researchers prefer to maintain the specimens in the same container. However, often the available centrifuge rotors have bores which are too large for such sealed containers.

Although bore reduction adapters are known, labware failure is a concern because toxic or corrosive specimens which leak from the labware can infiltrate the environment of the centrifuge location. Labware failure and labware seal failure can be expected in centrifuges because as the speed of use increases, so does seal pressure. Specimens may then, by centripetal force, attack further seals and possibly escape from the centrifuge, especially where the centrifuge chamber pressure is low, i.e. below ambient, say one-quarter atmosphere and below. Some laboratories require double and even triple seals to prevent accidental contamination of the laboratory environment.

Seals for centrifuge rotors which use centrifugal force to force a cap or plug against a container are known. For example, see U.S. Pat. Nos. 5,127,895 to R. Pawlovich; 5,395,001 to P. Moore; 5,361,922 to P. Moore et al.; 4,304,356 to S. Chulay et al.; 4,290,550 to S. Chulay et al.; 4,080,175 to S. Chulay et al.; and 4,076,170 to S. Chulay et al., all assigned to the assignee of the present invention. In some of these patents, deformable o-rings are used as part of the seal mechanism. Tapered surfaces, annular ridges and annular grooves are all employed, as in U.S. Pat. No. 5,395,001 to achieve a sealed sample.

An object of the invention was to devise a rotor adapter which incorporates good seals, which provides protection in the event of labware failure, which is easy to insert into, and remove from, a rotor and which seals easily.

SUMMARY OF INVENTION

The above object has been met with a labware adapter featuring a tubular body having spaced apart upper and lower annular collars, nestable within a centrifuge bore, with an overflow reservoir therebetween. Between the annular collars the body is recessed away from the bore wall to provide the overflow reservoir for any fluid escaping from the labware. Thus, at its ends, the tubular body fits snugly into the bore of a rotor, a while between the ends, a relief zone provides a zero mass reservoir, using the bore itself as one of the containment walls. The upper and lower collars have grooves or indentations which allow fluid bypassing of the collars. For example, fluid, including air, in the rotor bore prior to use, is displaced from the bore and bypassed past the tubular body as the tubular body is inserted into the bore. In this manner, the adapter is self-seating.

An annular ridge at the external peripheral extremity of the tubular body, above the upper annular collar, has a pair of slightly spaced apart seal glands which seat o-rings or sealing compound. A tubular cap having a radius greater than the tubular body, but not exceeding the maximal radial extent of the upper collar, has a rim which is pushed onto the upper collar, overlapping the annular ridge, and receives support from the collar. A close fit between the cap and the tubular body at the annular ridge portion of the tubular body effects sealing between the cap and the body, with elastomeric o-rings being compressed increasingly as centrifugal force increases. The cap is merely pushed onto the tubular body after labware has been loaded in the body and the rotor seating the body is spun. No special tools or threads are needed for sealing. In this regard, the adapter is self-sealing.

In this patent application the following definitions are used:

- Adapter—any device consisting of a singular or Imultiple components which reduces a larger volume cell bore into a smaller volume cell bore and surrounds and supports smaller labware. This device may be open-ended or a closed container.
- Tubular Body—the lower portion of the adapter system, usually the main supporting structural component for labware, with an open top and a closed bottom.
- Cap—the upper portion of the adapter system, closing the open top of the tubular body.
- Seal—usually an o-ring or similar elastomer or polymer material or device which can conform to a seal gland by virtue of its own self-loading or centrifugal loading of gland structures.
- Gland—a channel or groove which supports and constrains a seal.
- Labware—any bottle, tube or sample holding device used to contain and support a sample fluid or material to be centrifuged. In this application, the labware is placed in the adapter.

BEST MODE OF CARRYING OUT THE INVENTION

Figure 1:
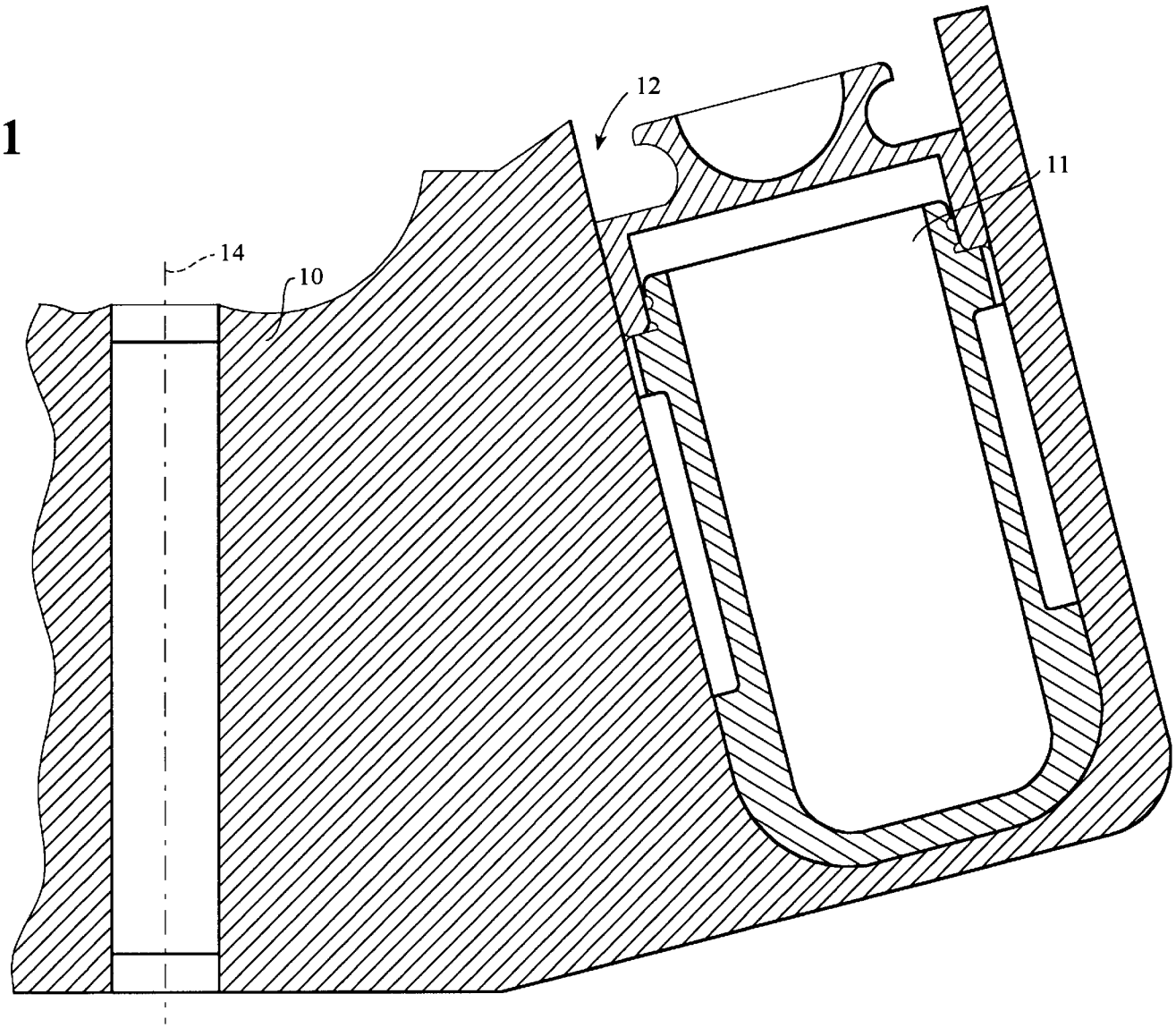
FIG. 1 is a sectional view of the labware adapter of the present invention seated within a centrifuge rotor.

With reference to FIG. 1, a centrifuge rotor 10, having a spin axis 14, is shown with a bore 12 where an adapter may be seated, such as adapter 11. Within the adapter, labware, not shown, is placed for centrifugation. The labware is typically a closed vial or cuvette, a closed dish or other closed specimen holder. The bores may be inclined at an angle, or may be near vertical, as shown. At least a slight angle of inclination of the bore is preferred so that centrifugal force will load the adapter cap onto the adapter body as described below. The adapter serves to reduce the bore size for the labware so that the labware can be seated near the axis of the bore for best results during centrifugation, although this is not necessary.

Figure 2:
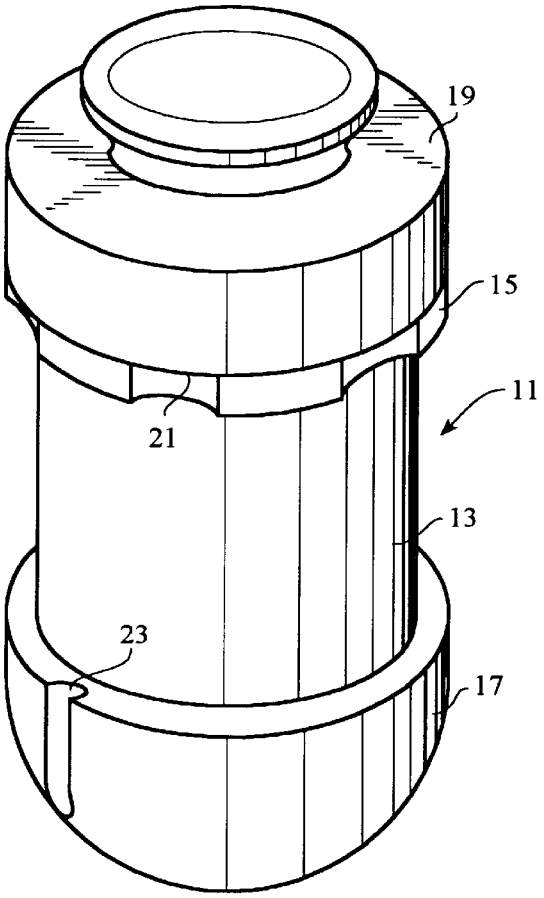
FIG. 2 is a perspective view of the labware adapter of FIG. 1.

In FIG. 2, the adapter 11 has a tubular body 13 and a cap 19. The body 13 has an upper annular collar 15 and a lower annular collar 17, both collars acting as piloting members, guiding the adapter into a nesting relation with the rotor bore, as well as acting as structural supports. The upper collar 15 supports cap 19 and has a plurality of circumferentially spaced indentations 21 which reduce the weight of the collar without loss of structural integrity. The indentations have a contour for fitting human fingers, allowing the adapter to be handled conveniently and providing a fluid passageway discussed below. A vent channel 23 in the lower annular collar 17 allows fluid, including air, to pass the collar without restriction. This is particularly useful when inserting the adapter into a bore with a closed bottom, allowing the adapter to move into its nested position with low resistance. The vent channel is similarly useful upon removal of the adapter from the bore, preventing a vacuum from building up between the adapter body and the bore. The vent channel must not be so large in cross sectional area as to create a dynamic loading condition that might cause stress on the adapter, leading to premature failure of the adapter or rotor.

Figure 3:
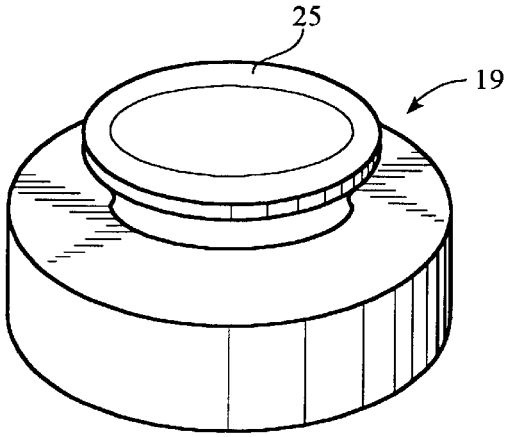
FIG. 3 is a perspective view of the cap of the labware adapter of FIG. 2.
Figure 4:
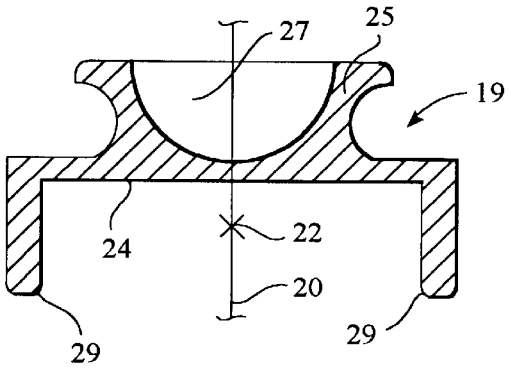
FIG. 4 is a cross sectional view of the cap illustrated in FIG. 3.

In FIGS. 3 and 4 the cap 19 is seen to have a knob 25 for grasping by human fingers. A circular recess 27, allowing entry of one or two finger tips, facilitates removal of the adapter from a rotor bore, or removal of the cap 19 from the tubular body on which it is lodged. The height of the knob 25 is kept low so as not to adversely raise the center of gravity of the adapter, yet still allowing easy grasping.

In FIG. 4 cap 19 has a central cylindrical axis 20, with the center of gravity of the cap being on the axis at a location 22, just below the internal cap surface 24. A low center of gravity keeps the cap from rotating if the cap experiences a local centrifugal force, tending to twist the cap. Any rotation would decompress cap seals and possibly lead to leakage of the adapter. The recess 27, then, is for both mass reduction and to keep the center of gravity low.

Figure 5:
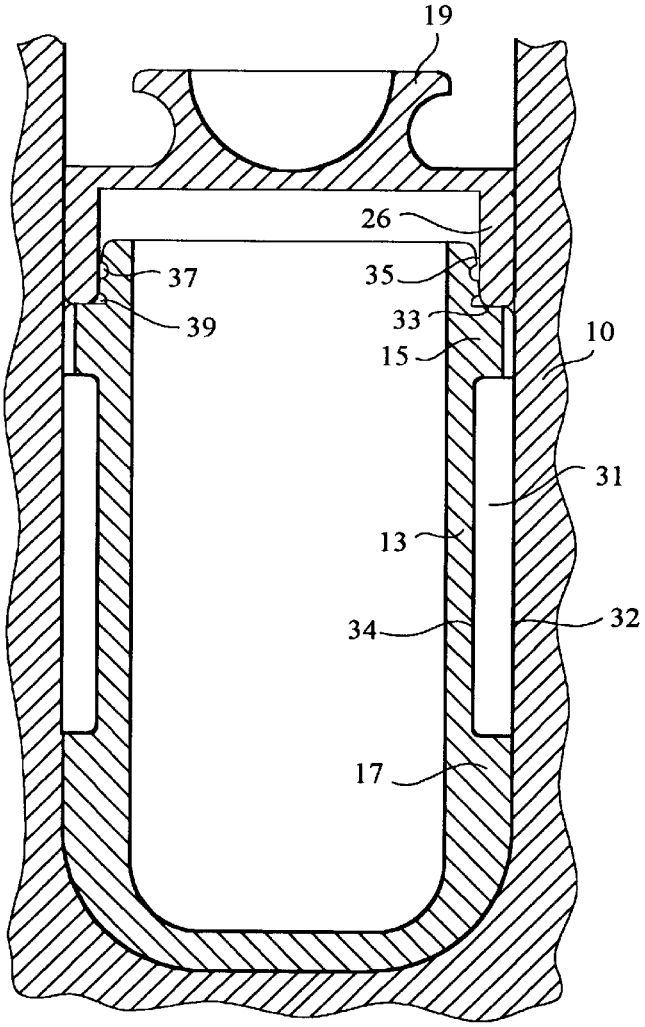
FIG. 5 is a cross sectional view of the labware adapter of FIG. 1.

In FIG. 5, the tubular body 13 is seen to define a fluid reservoir 31 relative to the wall of the bore in rotor 10. The reservoir 31 is bounded on upper and lower sides by the upper collar 15 and the lower collar 17. Laterally, the reservoir is bounded by the internal rotor wall surface 32 and by the external adapter surface region 34. The reservoir is intended to contain any fluid which might escape past labware seals and past seals adjacent to the cap, namely o-ring seals in annular glands 37 and 39. Note that the annular foot 26 of cap 19 rests on the shoulder 33 of the upper collar 15, overlapping ridge 35 which is that portion of the tubular body 13 above the upper collar 15. Within the ridge 35, the annular glands 37 and 39 are defined. The foot 26 of the cap compresses the o-ring seals in the annular glands. Fluid escaping from labware must traverse these seals which form the secondary and tertiary containment seals for the system, the labware seal being the primary seal. After escaping through these seals, fluid would find a path to reservoir 31 by flowing through the indentations 21 in the upper collar 15. The volume of reservoir 31 is designed to contain the worse case fluid leak and is based on such factors as rotor angle and maximum fill volume of the labware. Preferably, a volume in the range of 10–20% of the maximum labware fluid fill volume is provided. The recess provided by reservoir 31 serves to reduce the mass of the adapter, as well as providing a containment feature.

Figure 6:
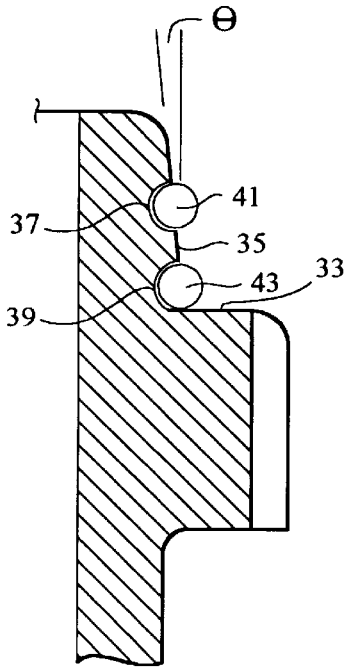
FIG. 6 is a cross sectional detail of the upper collar and ridge of the tubular body of the labware adapter shown in FIG. 2.

In FIG. 6, the ridge 35 is seen to have a taper relative to vertical. The taper, represented by angle θ is only a few degrees and allows the cap to be guided onto shoulder 33, compressing o-rings 41 and 43.

Figure 7:
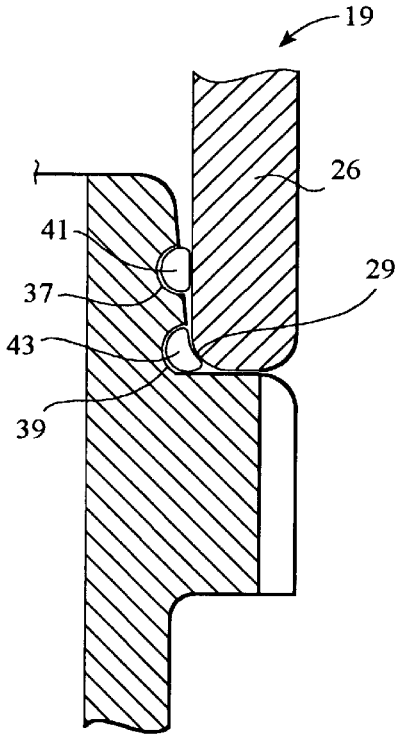
FIG. 7 is a cross sectional detail of the upper collar and ridge of the tubular body of the labware adapter shown in FIG. 2 with the rim of the cap sealed in place.

In FIG. 7 cap 19 is shown compressing o-ring seals 41 and 43. The foot 26 of cap 19 has a radius 29 which is adjacent to the lower seal gland 39. The radius 29 smoothly turns the surface of the foot 26 between a vertical wall surface and a horizontal wall surface. The cap 19 is shown as a centrifugally loaded position wherein both o-ring seals 41 and 43 are in compression.

Figure 8:
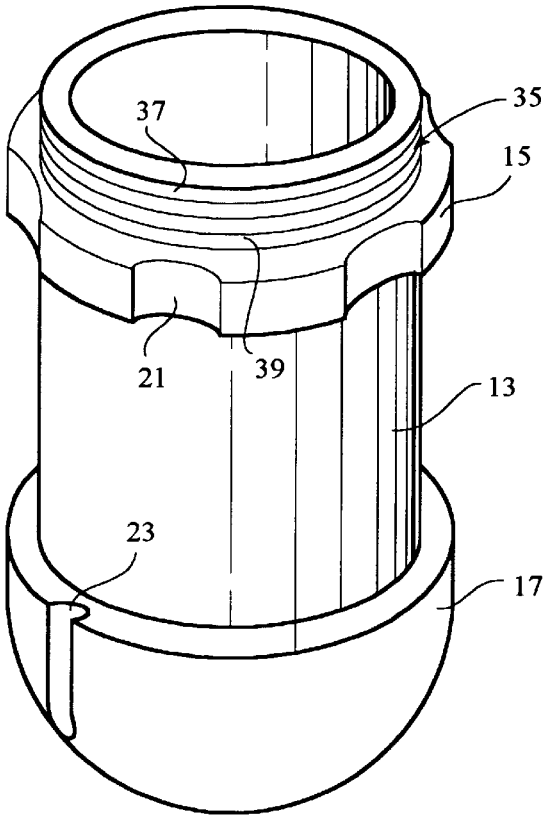
FIG. 8 is a perspective view of the tubular body of the labware adapter shown in FIG. 1 with the cap removed.
Figure 9:
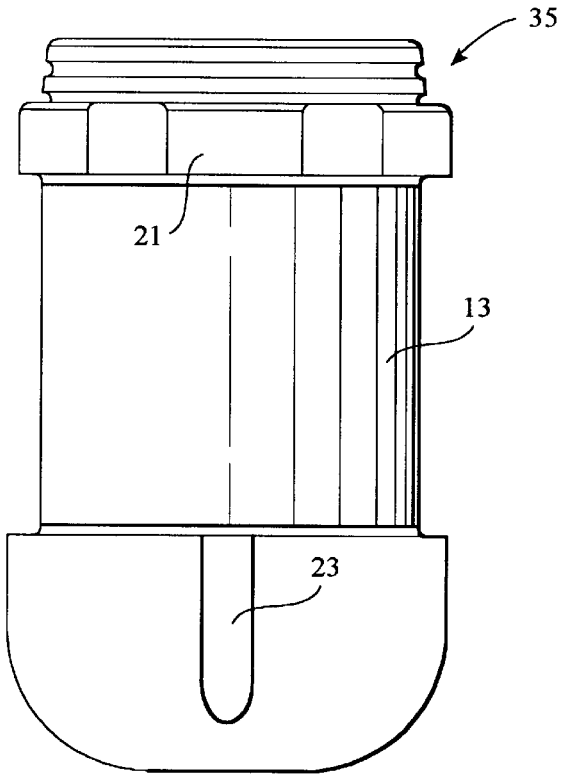
FIG. 9 is a front elevation of the tubular body shown in FIG. 8.

In FIGS. 8 and 9 the tubular body 13 of the adapter is seen to have upper collar 15 and lower collar 17. Note that the ridge 35 does not have threads for retaining a cap, but has annular grooves in the ridge forming seal glands 37 and 39, allowing a cap to be press fit onto the glands. The present invention encompasses caps which overlap the annular grooves of the cap, but have a locking feature, such as a bayonet mounting. In the preferred embodiment, the cap is pressed onto the tubular body, without twisting. Vent channel 23 is seen to have a vertical extent overlapping the curved lower portion of lower collar 17. The curved portion matches the internal radius of a rotor bore for a close nesting relation therewith.

In use, labware is loaded into the tubular body of the adapter and the cap is pressed into a seated position on the shoulder of the upper annular collar. The adapter is dropped into a rotor bore and the centrifuge is started, further loading the cap onto the adapter body for full sealing action. In the rare situation where the labware would fail and the o-ring seals also fail, any fluid from the labware would flow over indentations in the upper collar of the tubular body and into the annular reservoir between upper and lower collars.

I claim:

1. A labware adapter for a centrifuge of the type having a material receiving bore defined in a centrifuge rotor comprising, a tubular body having an annular ridge above an annular collar, the ridge having at least two annular seal glands defined therein, the annular collar fitting closely within the bore of a rotor of a centrifuge, and a threadless cap fitting tightly over the annular ridge and contacting the annular collar.

2. A labware adapter for a centrifuge of the type having a material receiving bore defined in a centrifuge rotor comprising, a tubular body, with an open top and a closed bottom having spaced apart upper and lower annular collars having circumferential dimensions allowing the tubular body to nest within a rotor bore, the annular collars having peripheral indentations for fluid flow past the collars, the tubular body having an annular ridge above the upper annular collar with a circumferential dimension less than the upper annular collar and defining seal glands therein, and a cap having a rim fitting about the ridge of the tubular body in close proximity to the seal glands, thereby closing the top of the tubular body.

3. The adapter of claim 2 wherein the lower collar of the tubular body has a radius facing into the bore.

4. The adapter of claim 2 wherein the rim of the cap has a radius facing the upper annular collar.

5. The adapter of claim 2 wherein elastomers are disposed in the teal glands.

6. The adapter of claim 2 wherein the annular collars define a circumferential recess therebetween serving as a fluid reservoir in combination with a wall defined by the rotor bore.

7. The adapter of claim 2 wherein the cap has a knob on the upper external periphery of the cap.

8. The adapter of claim 7 wherein the knob of the cap has an indentation having a size suitable for finger entry.

9. The adapter of claim 2 wherein the annular ridge has a taper in the outer peripheral surface thereof, extending inwardly in the upward direction.

10. The adapter of claim 2 wherein the indentations in the upper collar comprise a plurality of indentations, spaced about the outer periphery of the upper collar.

11. A labware adapter for a centrifuge of the type having a cylindrical, material receiving bore defined in a centrifuge rotor comprising, a tubular body having a central axis and opposed upper and lower ends, the upper end being open and the lower end being closed, the tubular body including an annular upper collar below an annular ridge at the external peripheral extremity of the upper end and an annular lower collar at the external peripheral lower end of the tubular body, with a central body portion between the upper and lower collars, the upper and lower collars extending radially outwardly from the axis of the tubular body to a maximum radius slightly less than a cylindrical bore of a centrifuge rotor, the annular ridge having at least two annular seal glands defined therein, and a cap having an outer radius greater than the radius of the annular ridge of the tubular body but not exceeding the maximal radial extent of the upper collar, the cap having a central axis and an inner wall tapered relative to the central axis of the tubular cap, the tubular cap having a threadless rim contacting the ridge of the tubular body, overlapping the seal glands, whereby the upper collar supports the tubular cap in a sealed relation.

12. The adapter of claim 11 further comprising a plurality of indentations defined in the annular upper collar of the tubular body at the outer periphery thereof, the indentations having a shape allowing fluid communication between the annular ridge and the central body portion of the tubular body.

13. The adapter of claim 12 further comprising at least one vent channel defined in the annular lower collar of the tubular body at the outer periphery thereof, the vent channel having a shape allowing fluid communication between the central body and a region near the lower end whereby gas in a rotor bore can blow past the lower and upper collars of the tubular body upon insertion of the tubular body into a rotor bore.

14. The adapter of claim 12 wherein a fluid reservoir is defined about the periphery of the tubular body between the annular upper and lower collars, the collars spaced apart and having a radial extent relative to the tubular body such that the volume of the fluid reservoir is greater than 10–20% of the maximum labware fluid fill volume.

15. The adapter of claim 12 wherein said indentations have a contour accommodating human fingers.

16. The adapter of claim 11 further comprising a plurality of elastomeric o-rings, one o-ring seated in each of said annular seal glands.

17. The adapter of claim 16 wherein said tubular cap has an edgewise radius at the inner periphery of the cap rim, the radius, the seal glands and at least one o-ring mutually positioned so that the radius contacts one of the elastomeric o-rings.

18. The adapter of claim 16 wherein all of said o-rings contact the rim of said tubular cap.

19. The adapter of claim 11 wherein said tubular cap has an edgewise radius at the inner periphery of the cap rim.

20. The adapter of claim 11 wherein said tubular cap has an external boss located on the central axis at an end of the cap opposite the rim.

21. The adapter of claim 20 wherein the external boss has a mass relief depression therein.

* * * * *